US007101330B2

(12) United States Patent
Elbaz et al.

(10) Patent No.: US 7,101,330 B2
(45) Date of Patent: Sep. 5, 2006

(54) PROPRIOCEPTIVE/KINESTHETIC APPARATUS AND METHOD

(76) Inventors: Avi Elbaz, 11 HaPisga Street, Dimona 86000 (IL); Amit Mor, 9 Smilanski Street, Rehovot 76446 (IL)

( * ) Notice: Subject to any disclaimer, the term of this patent is extended or adjusted under 35 U.S.C. 154(b) by 491 days.

(21) Appl. No.: 10/397,419

(22) Filed: Mar. 27, 2003

(65) Prior Publication Data

US 2004/0033864 A1 Feb. 19, 2004

Related U.S. Application Data

(63) Continuation-in-part of application No. 10/222,992, filed on Aug. 19, 2002, now Pat. No. 6,979,287.

(51) Int. Cl.
*A63B 26/00* (2006.01)
*A63B 71/00* (2006.01)

(52) U.S. Cl. ..... 482/148; 36/25

(58) Field of Classification Search ..... 482/148; 36/61, 134, 129, 67 R, 67 D, 127, 28, 36, 36/15, 25, 42; 12/70, 17 R, 79.5, 85
See application file for complete search history.

(56) References Cited

U.S. PATENT DOCUMENTS

2002/0026730 A1* 3/2002 Whatley ..... 36/132

* cited by examiner

*Primary Examiner*—Lori Amerson
(74) *Attorney, Agent, or Firm*—Dakel Patent Ltd.; David Klein

(57) ABSTRACT

Proprioceptive or kinesthetic exercise methods and apparatus are described. In one embodiment, a proprioceptive treadmill is described that comprises a foot-contact running surface that rotates about a pair of spaced pulleys, the running surface comprising at least one protuberance protruding upwards from the running surface. Proprioceptive exercise surfaces, exercise bicycles, steppers, ski machines, rowing machines and elliptic exercise machines are also described.

3 Claims, 8 Drawing Sheets

PROPRIOCEPTIVE/KINESTHETIC APPARATUS AND METHOD

RELATED APPLICATIONS

The present invention is a continuation-in-part of U.S. patent application Ser. No. 10/222,992, filed Aug. 19, 2002 mow U.S. Pat. No. 6,979,287, the contents of which are incorporated herein by reference in their entirety.

FIELD OF THE INVENTION

The present invention relates generally to apparatus for training, developing and enhancing proprioceptive and kinesthetic skills, neuromuscular control and core stability.

BACKGROUND OF THE INVENTION

Proprioception refers to the ability to know where a body part is located in space and to recognize movements of body parts (such as fingers and toes, feet and hands, legs and arms). Kinesthesia is a related term, and refers to the sensation by which position, weight, muscle tension and movement are perceived. In some of the medical literature, proprioception refers to the conscious and unconscious appreciation of joint position, while kinesthesia refers to the sensation of joint velocity and acceleration. Proprioception is often used interchangeably with kinesthesia, and herein as well, the terms will be used interchangeably. (Throughout the specification and claims, the term "proprioception" will be used to encompass proprioception, kinesthesia, core stability and the like.)

The neuromuscular control system of the body integrates peripheral sensations relative to joint loads and processes these signals into coordinated motor responses. This muscle activity serves to protect joint structures from excessive strain.

Certain mechanoreceptors are present throughout the soft tissues of the musculoskeletal system which interact with the central nervous system and coordinate body movements, postural alignment, and balance. Mechanoreceptors are located in the muscles, tendons, ligaments, joint capsules and the skin. These nerve fibers provide information to the brain regarding the status and function of the musculoskeletal system. The mechanoreceptors send electrical signals along peripheral nerves to the spinal cord. The electrical signals travel via the spinal cord to the brain where the signals are interpreted to recognize movements of body parts, muscle tension, movement and the like.

Some examples of mechanoreceptors for controlling the muscular system include muscle spindles. Muscle spindles are found interspersed within the contractile fibers of skeletal muscles, with the highest concentration in the central portion of each muscle. Muscle spindle fibers respond to changes in the length of muscles. These nerve endings provide the central nervous system information used to maintain muscle tone and the correct muscle tension on opposite sides of each joint.

Fibrous tissues that surround and protect most joints generally contain a variety of sensory nerve endings for proprioception and kinesthesia. The input from these sensory nerve endings provides the central nervous system information regarding the location, stretch, compression, tension, acceleration, and rotation of the joint.

The foot is the anatomical region that contains the second largest number of proprioceptive or kinesthetic sensory receptors in the body (the spine has the most).

Proprioceptive and kinesthetic exercises and exercise devices are well known for improving agility, balance and coordination, and for rehabilitation of persons whose proprioceptive ability has been impaired, such as after accidents or illness. One such class of exercise devices includes tilt boards, wherein a patient stands on a board or similar platform that has a ball mounted underneath. The board does not lie horizontal due to the presence of the ball, and this challenges the ability of the patient to balance and perform maneuvers on the platform. Repeated exercises on the tilt board may be used to develop or rehabilitate the proprioception and neuromuscular control of the patient, as well as strengthen muscles, tendons and connective tissues in the foot area.

Other known proprioceptive and kinesthetic exercise devices include a shoe with a single ball mounted underneath the sole of the shoe. The shoe with the ball is used similar to the tilt board. Another kind of shoe has a rod mounted underneath the sole of the shoe, used for strengthening dorsiflexor muscles.

Yet another proprioceptive and kinesthetic exercise device is described in U.S. Pat. No. 6,283,897 to Patton. This device consists of one or more pegs protruding upwards from a baseboard. The pegs have a rounded top and sit in concave depressions (divots) in the bottom of an overshoe shaped like a sandal. Specifically, the bottom of the shoe's sole has three concave, hemisphere-shaped divots, with one located within the heel portion, one directly underneath the ball of the foot, and one located in the center. Elastomeric bands may support the user's foot as the user turns his foot and/or hips to develop the strength, range of motion, and proprioception of the ankle and hips.

SUMMARY OF THE INVENTION

The present invention seeks to provide novel proprioceptive and kinesthetic exercise apparatus, which provides significant advantages over prior art apparatus, such as tilt boards or shoes with a single protrusion. As is described more in detail hereinbelow, in one embodiment of the present invention, footwear is provided that includes two bulbous protrusions protruding from the underside thereof, instead of the single ball of the prior art boards and shoes. The extra protrusion may significantly increase the possibilities and enable walking, and accelerate and improve the results of proprioceptive and kinesthetic treatment plans. Other proprioceptive and kinesthetic exercise devices are provided, such as novel treadmills, exercise surfaces, exercise bicycles, exercise steppers, ski machines or elliptic exercise machines, as is described more in detail hereinbelow.

The apparatus of the present invention may be used in proprioceptive, neuromuscular control and coordinative exercises and training for children and athletes alike, for developing and improving proprioceptive and kinesthetic ability. The invention may be used to perform exercises and training to prevent injuries in athletes and non-athletes alike. The invention may be used to work on core stability for stabilizing the back and hips area, to prevent, stop or reduce back pain. The invention may be used in exercising and training persons who have had ankle, knee, hip and back injuries in the past (or other injuries) in order to prevent future recurrences of such injuries. The invention may be used in exercising and training persons with physical handicaps (e.g., cerebral or neurological diseases or other disabilities). A user of the exercise devices of the invention may move in six degrees of freedom (translation in three mutually orthogonal directions (x, y, z) and rotation about these axes (azimuth, elevation and roll)). All of the exercises and training sessions involve causing instability to the person while in motion, particularly translational motion—walking, running or other movement.

There is thus provided in accordance with an embodiment of the present invention an exercise apparatus comprising a foot-contact surface adapted to support a user's foot thereon, an actuator adapted to move the foot-contact surface during an exercise plan, and a bumping mechanism operative to disrupt a balance of a user on the foot-contact surface.

In accordance with an embodiment of the present invention the bumping mechanism is operative to move the user in six degrees of freedom, comprising translation in three mutually orthogonal directions and rotation about these axes.

There is also provided in accordance with an embodiment of the present invention a method comprising performing a proprioceptive exercise comprising overcoming a balance-disruptive force while moving in translational motion.

There is also provided in accordance with an embodiment of the present invention a method comprising performing an exercise on an exercise machine that is initially devoid of balance-disruptive forces, and deliberately applying a balance-disruptive force while exercise on the exercise machine.

BRIEF DESCRIPTION OF THE DRAWINGS

The present invention will be understood and appreciated more fully from the following detailed description taken in conjunction with the appended drawings in which.

DETAILED DESCRIPTION OF THE PRESENT INVENTION

Figure 1:
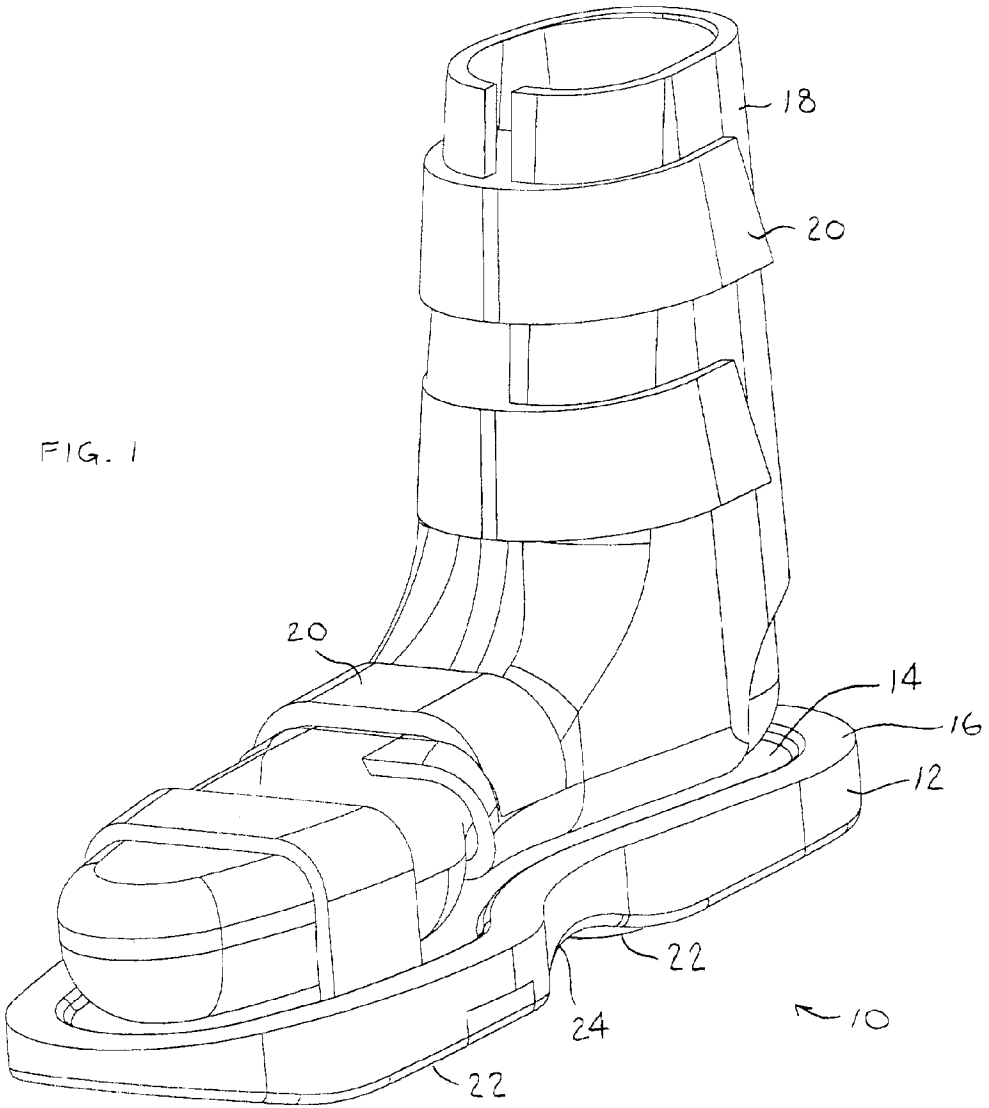
FIG. 1 is a simplified pictorial illustration of footwear constructed and operative in accordance with an embodiment of the present invention.

Reference is now made to FIGS. 1–4, which illustrate footwear 10 constructed and operative in accordance with an embodiment of the present invention. Footwear 10 may be supplied as one or more pairs of shoe-like devices, or alternatively, as just one of the shoe-like devices.

Footwear 10 preferably comprises a support member 12 having a periphery in a shape of a shoe sole with an upper surface 14. In the illustrated embodiment, the upper surface 14 is indented with a peripheral ridge 16, but it is appreciated that other configurations of upper surface 14 are within the scope of the invention. Footwear 10 may be attached to a foot of a user (not shown) by means of a boot 18 and/or fasteners 20, such as but not limited to, VELCRO straps, buckles, shoe laces, and the like. Boot 18 may be fashioned for attachment to the user's foot with or without fasteners 20. Similarly, fasteners 20 may be used to attach footwear 10 to the user's foot without boot 18.

Two bulbous protuberances 22 may protrude from a lower surface 24 of support member 12. Alternatively, bulbous protuberances 22 may protrude from the upper surface 14 of support member 12. Each protuberance 22 may have a curved outer contour 26. The cross-section of the contour 26, that is, either the cross-section taken with respect to a longitudinal axis 28 (FIG. 4) of support member 12 (corresponding to the shape seen in FIG. 2) or the cross-section taken with respect to a latitudinal axis 30 (FIG. 4) of support member 12 (corresponding to the shape seen in FIG. 3), or any other cross-section, may have any curvilinear shape. For example, the contours 26 may have the shape of a conic section, that is, the shape of a circle, ellipse, parabola or hyperbola. The various cross-sections of the contours 26 of protuberance 22 may be shaped identically or differently.

Figure 2:
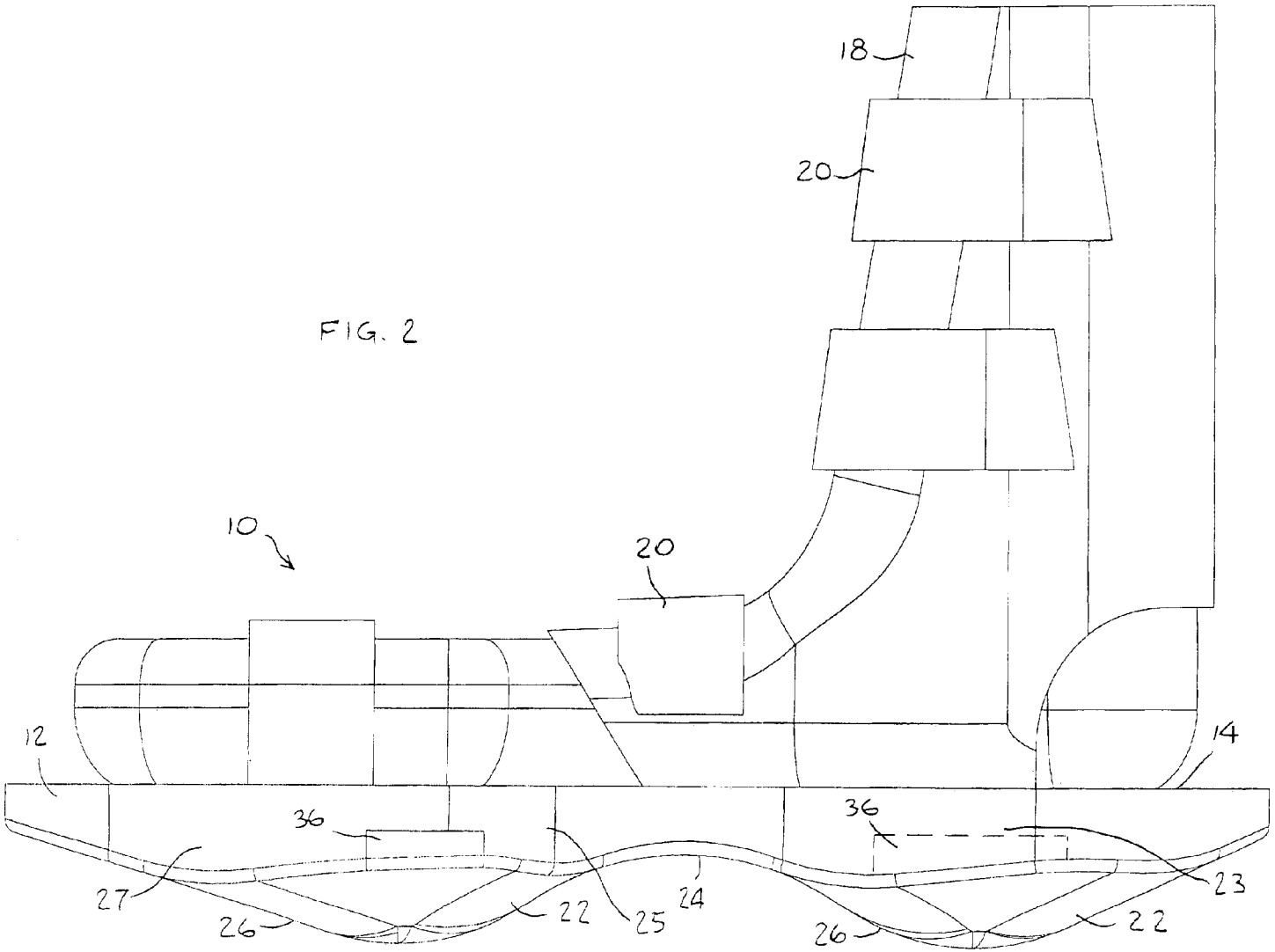
FIGS. 2 and 3 are simplified side-view and rear-view illustrations, respectively, of the footwear of FIG. 1.
Figure 4:
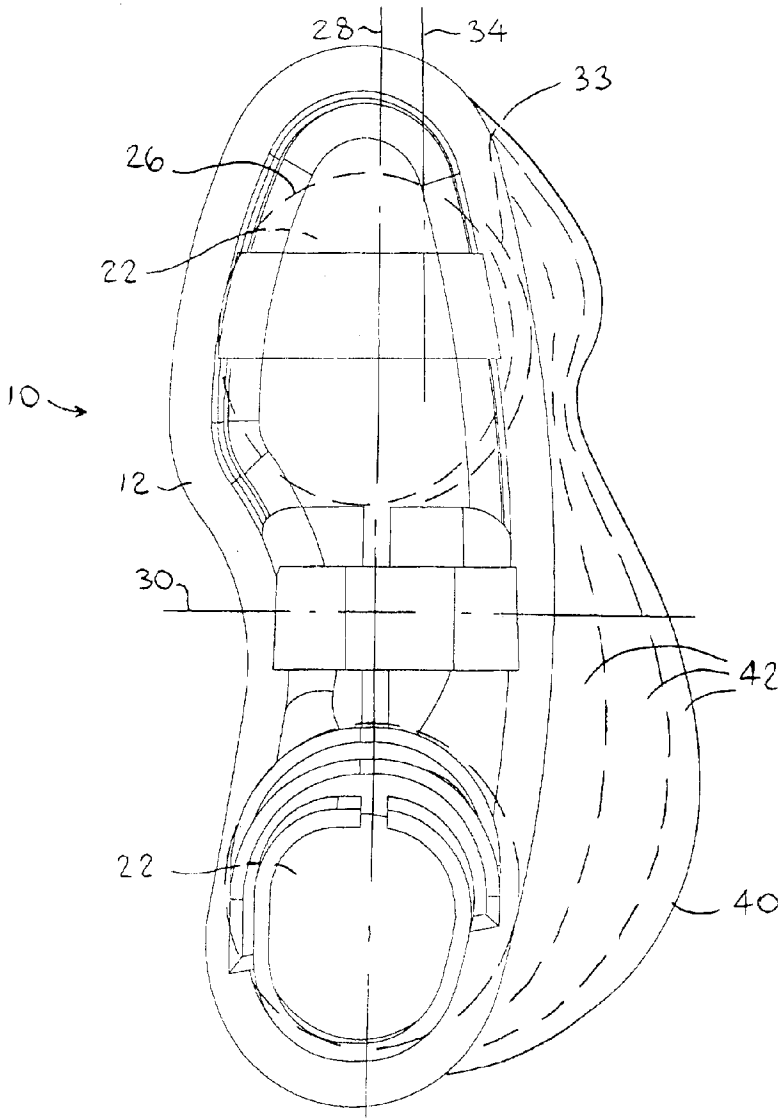
FIG. 4 is a simplified top-view illustration of the footwear of FIG. 1, showing further features of other embodiments of the present invention.

As seen clearly in FIG. 2, one protuberance 22 may be positioned more posteriorly than the other protuberance 22. As seen in FIG. 4, the protuberances may be positioned on a common longitudinal axis of support member 12, such as the centerline 28 of support member 12, and on opposite sides of the latitudinal midline 30. As seen in FIG. 2, the rearward protuberance 22 may be positioned generally underneath a calcaneus (heel, ankle) support portion 23 of support member 12, while the forward protuberance 22 may be positioned generally underneath a metatarsals support portion 25 and/or phalanges support portion 27 of support member 12.

Alternatively, as indicated by broken lines 33 in FIG. 4, one of the protuberances 22 (e.g., the forward one) may be aligned on a longitudinal axis 34 offset from centerline 28, and the rearward protuberance 22 may be positioned offset from axis 34, such as on the centerline 28. It is appreciated that the above are just some examples of positioning the protuberances 22, and many other possibilities exist within the scope of the invention.

The protuberances 22 may be constructed of any suitable material, such as but not limited to, elastomers or metal or a combination of materials, and may have different properties. For example, the protuberances may have different resilience or hardness, such as having different elasticity properties or Shore hardness. The protuberances 22 may protrude by different amounts from the lower surface 24 of support member 12.

In accordance with an embodiment of the present invention, one or more protuberances 22 may be slidingly mounted on support member 12. For example, protuberance 22 may be mounted on a track 36 (FIG. 2) formed in the lower surface 24 of support member 12, and may be selectively positioned anywhere along the track and fastened thereto. Track 36 may extend along a portion of the shoe sole or all along the length of the shoe sole. Alternatively or additionally, the amount of protrusion of protuberance 22 may be adjusted, such as by mounting protuberance 22 with a threaded fastener 38 (FIG. 3) to support member 12 and tightening or releasing threaded fastener 38.

Figure 3:
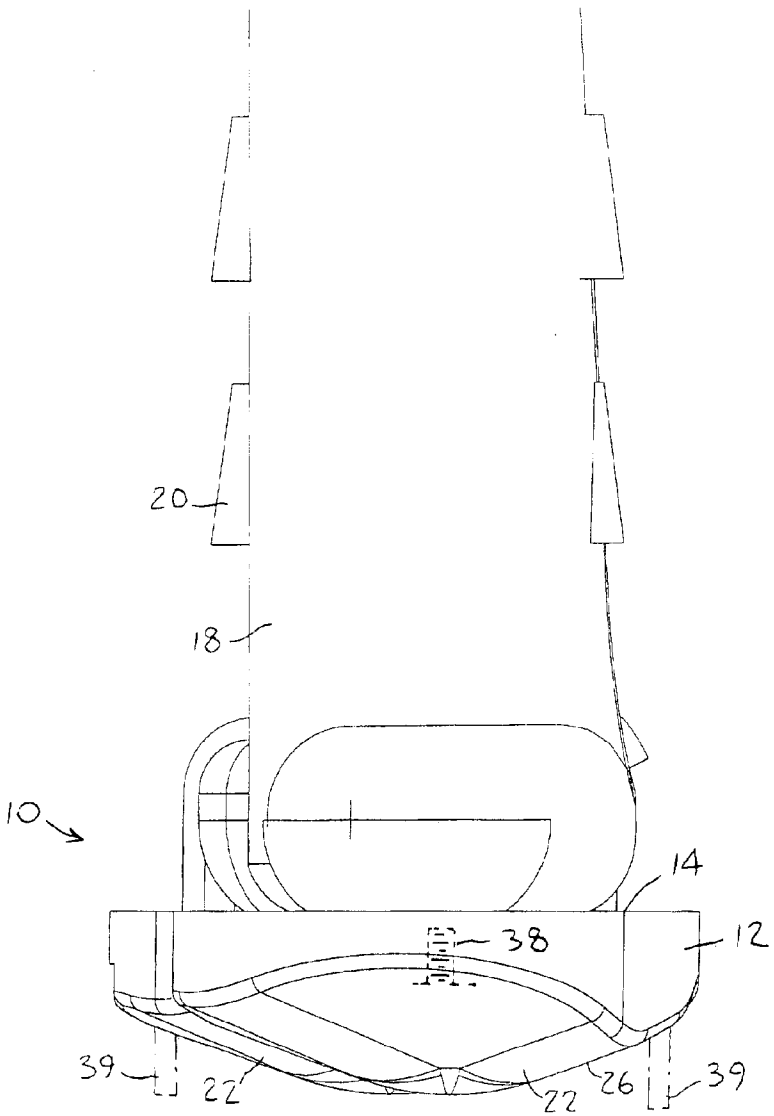

In accordance with an embodiment of the present invention, in addition to the bulbous protuberances 22, there further may be provided one or more non-bulbous protuberances 39, shown in FIG. 3. Protuberances 39 may be formed in the shape of a peg, stud, bolt, pin, dowel and the like, although the invention is not limited to these shapes. Protuberances 39 may be rigid or flexible. As with protuberances 22, the protuberances 39 may have different resilience or hardness, such as having different elasticity properties or Shore hardness, and they may protrude by different amounts from the lower surface 24 of support member 12. As above, the amount of protrusion of protuberances 39 may be adjusted. Protuberances 39 may be mounted at any place on the lower surface 24 of support member 12.

The features described above, such as the protuberances 22 being slidingly mounted on support member 12, may be implemented in the alternative embodiment wherein the bulbous protuberances 22 protrude from the upper surface 14 of support member 12. For example, footwear 10 may have a normal outer sole and have a sliding/shifting mechanism for the protuberances 22 inside the sole of footwear 10. The sliding/shifting mechanism may comprise, without limitation, a mechanism that floats in a viscous matrix (e.g., fluid in a chamber formed in the sole) or that is suspended by inner cables.

Reference is now made to FIG. 4. In accordance with an embodiment of the present invention, footwear 10 may comprise a flange 40 that extends outwards from the periphery of support member 12. In the illustrated embodiment, flange 40 extends sideways outwards from the periphery of support member 12, but it is appreciated that flange 40 may extend forwards or rearwards or in any other direction as well. Flange 40 may be provided on one side of footwear 10, as illustrated, or may be provided on both sides. Flange 40 may supplement the range of proprioceptive exercises possible with footwear 10, by providing an additional support surface during tilting and maneuvering with footwear 10.

Flange 40 may be constructed of any suitable material, such as but not limited to, elastomers or metal or a combination of materials, and may have portions 42 with different properties. For example, portions 42 may have different resilience or hardness, such as having different elasticity properties or Shore hardness. The portions 42 of flange 40 may have differently curved contours. Flange 40 may be adjustably attached to support member 12 such that the amount that flange 40 extends from support member 12 is adjustable.

A user may attach footwear 10 to his/her foot and perform a variety of maneuvers in a proprioceptive and/or kinesthetic exercise plan for the lower foot, upper leg and even upper torso and other body parts and organs. For example, footwear 10 may be used to reestablish neuromuscular control during rehabilitation of joints, to restore the mechanical and functional stability of the neuromuscular system, to improve or rehabilitate anticipatory (feed-forward) and reflexive (feed-back) neuromuscular control mechanism, and to regain and improve balance, postural equilibrium and core stability.

Figure 5:
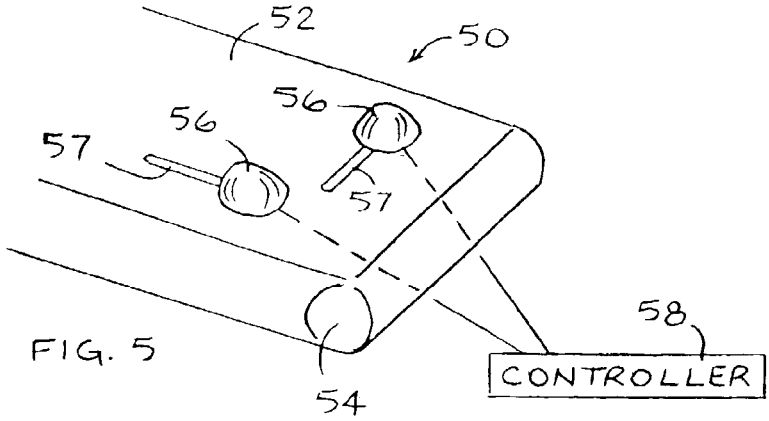
FIG. 5 is a simplified pictorial illustration of a treadmill constructed and operative in accordance with an embodiment of the present invention.

Reference is now made to FIG. 5, which illustrates a treadmill 50 constructed and operative in accordance with an embodiment of the present invention.

Treadmill 50 may comprise a foot-contact running surface 52 that rotates about a pair of spaced pulleys 54. Running surface 52 may comprise one or more protuberances 56 protruding upwards from running surface 52. Protuberances 56 may be of different or similar configuration (e.g., height, size, shape and/or slope). Protuberances 56 may have a fixed size/shape, or alternatively, may have a variable size/shape. The variable size/shape may be achieved by constructing protuberance 56 from an inflatable element, which may be inflated pneumatically with air or hydraulically with a liquid (e.g., water or oil). A controller 58 may be provided that controls inflation and deflation of protuberances 56. Protuberances 56 and/or running surface 52 may have different or similar material properties. For example, they may have different or similar resilience or viscosity (in the inflatable version) and may be made of different or similar materials.

Protuberances 56 may be movable. For example, one or more of the protuberances 56 may be translatable such as in a track 57 (e.g., forwards, backwards, sideways or diagonally) and/or rotatable about its own or other axis, or a combination of such motions. A protective strap (not shown) may be provided to maintain the user in an upright position and help prevent accidental falls.

Figure 6:
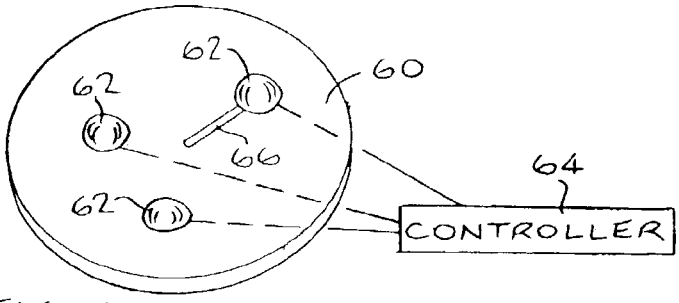
FIG. 6 is a simplified pictorial illustration of an exercise surface constructed and operative in accordance with an embodiment of the present invention.

Reference is now made to FIG. 6, which illustrates an exercise surface 60 constructed and operative in accordance with an embodiment of the present invention. Exercise surface 60 may comprise one or more protuberances 62 protruding upwards from the upper (foot-contacting) face and/or lower (floor-contacting) face of exercise surface 60. Protuberances 62 may be of different or similar configuration (e.g., height, size, shape and/or slope). Protuberances 62 may have a fixed size/shape, or alternatively, may have a variable size/shape. The variable size/shape may be achieved by constructing protuberance 62 from an inflatable element, which may be inflated pneumatically with air or hydraulically with a liquid (e.g., water or oil). A controller 64 may be provided that controls inflation and deflation of protuberances 62. Protuberances 62 may have different or similar resilience or viscosity (in the inflatable version), and may be made of different or similar materials.

Protuberances 62 may be movable. For example, one or more of the protuberances 62 may be translatable such as in a track 66 (e.g., forwards, backwards, sideways, radially or diagonally) and/or rotatable about its own or other axis, or a combination of such motions. A user of the exercise surface 60 may thus move in six degrees of freedom (translating in three mutually orthogonal directions (x, y, z) and rotating about these axes (azimuth, elevation and roll)).

Figure 7:
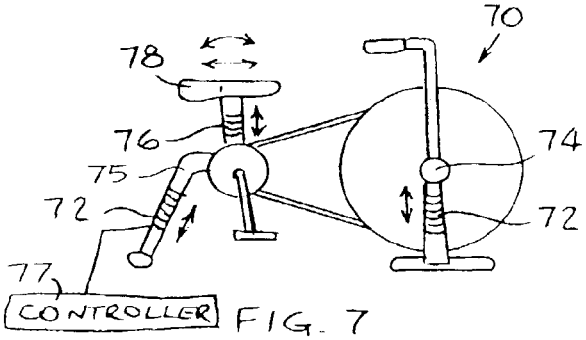
FIG. 7 is a simplified pictorial illustration of an exercise bicycle constructed and operative in accordance with an embodiment of the present invention.

Reference is now made to FIG. 7, which illustrates a stationary exercise bicycle 70 constructed and operative in accordance with an embodiment of the present invention. Exercise bicycle 70 may comprise apparatus with its own pedals, wheel and sensors (e.g., speedometer, odometer, etc.) or may comprise an indoor bicycle trainer, wherein a user mounts a bicycle to a stand, which permits pedaling the bicycle while the bicycle remains stationary. Exercise bicycle 70 may comprise a bumping mechanism 72 connected to a front axle 74 or rear support 75 of bicycle 70 and/or a bumping mechanism 76 connected to a seat 78 of bicycle 70. The bumping mechanisms may oscillate, rock, bump and otherwise disrupt the balance of the user of the exercise bicycle 70 (as indicated by arrows in FIG. 7). The bumping mechanisms may move the rider in six degrees of freedom (translation in three mutually orthogonal directions (x, y, z) and rotation about these axes (azimuth, elevation and roll)). The bumping mechanisms in this embodiment, as in other embodiments of the invention, may comprise a plate on which exercise bicycle 70 is mounted, wherein the plate provides the bumping action in six degrees of freedom.

Exercise bicycle 70 may be used to exercise the neuromuscular control in the back, hip, pelvis, ankle, knee and other parts of the body by means of bumps during riding, which may simulate riding on bumpy roads. A controller 77 may be provided to control operation of bumping mechanism 72.

Figure 8:
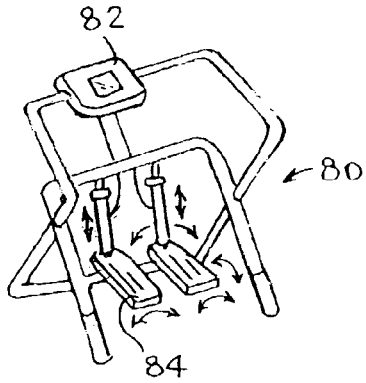
FIG. 8 is a simplified pictorial illustration of an exercise stepper constructed and operative in accordance with an embodiment of the present invention.

Reference is now made to FIG. 8, which illustrates an exercise stepper 80, constructed and operative in accordance with an embodiment of the present invention. Exercise stepper 80 may comprise a controller 82 that varies the resistive force offered by pedals 84 of the stepper 80. Controller 82 may also vary the angle of the pedals 84, such as to create eversion and inversion, as indicated by arrows in FIG. 8. Here too, controller 82 may move the pedals 84 in six degrees of freedom (translation in three mutually orthogonal directions (x, y, z) and rotation about these axes (azimuth, elevation and roll)).

Figure 9:
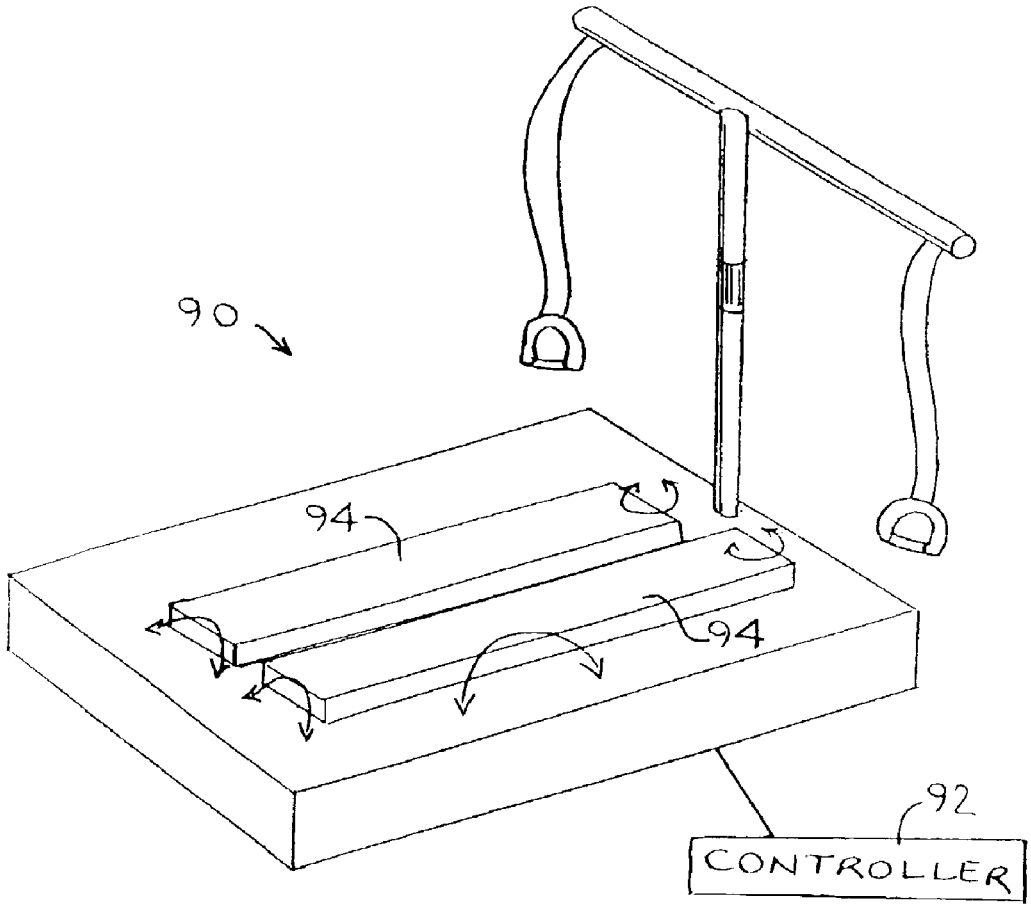
FIG. 9 is a simplified pictorial illustration of a ski machine constructed and operative in accordance with an embodiment of the present invention.

Reference is now made to FIG. 9, which illustrates a ski machine 90, constructed and operative in accordance with an embodiment of the present invention. Ski machine 90 may comprise a controller 92 that varies the resistive force offered by ski platforms 94 of the ski 90. Controller 92 may also vary the angle of ski platforms 94, such as to create eversion and inversion, as indicated by arrows in FIG. 9. Controller 92 may move the ski platforms 94 in six degrees of freedom (translation in three mutually orthogonal directions (x, y, z) and rotation about these axes (azimuth, elevation and roll)).

Some exercise experts have noted several drawbacks to prior art exercise equipment. For example, stationary exercise bicycles may utilize only a relatively small number of muscles, throughout a fairly limited range of motion. Cross-country skiing devices may exercise more muscles than a stationary bicycle, however, the substantially flat shuffling foot motion of the device may limit the range of motion of some of the muscles being exercised. Stair climbing devices may exercise more muscles than stationary bicycles, however, the limited range of up-and-down motion may not exercise the leg muscles through a large range of motion.

In response to these concerns, elliptic exercise machines have been developed that simulate natural walking and running motions and exercise a large number of muscles through a large range of motion. The machines provide variable, flexibly coordinated elliptical motion of the leg muscles. An example of one of the many elliptic exercise machines in the prior art is described in U.S. Pat. No. 5,848,954.

Figure 10:
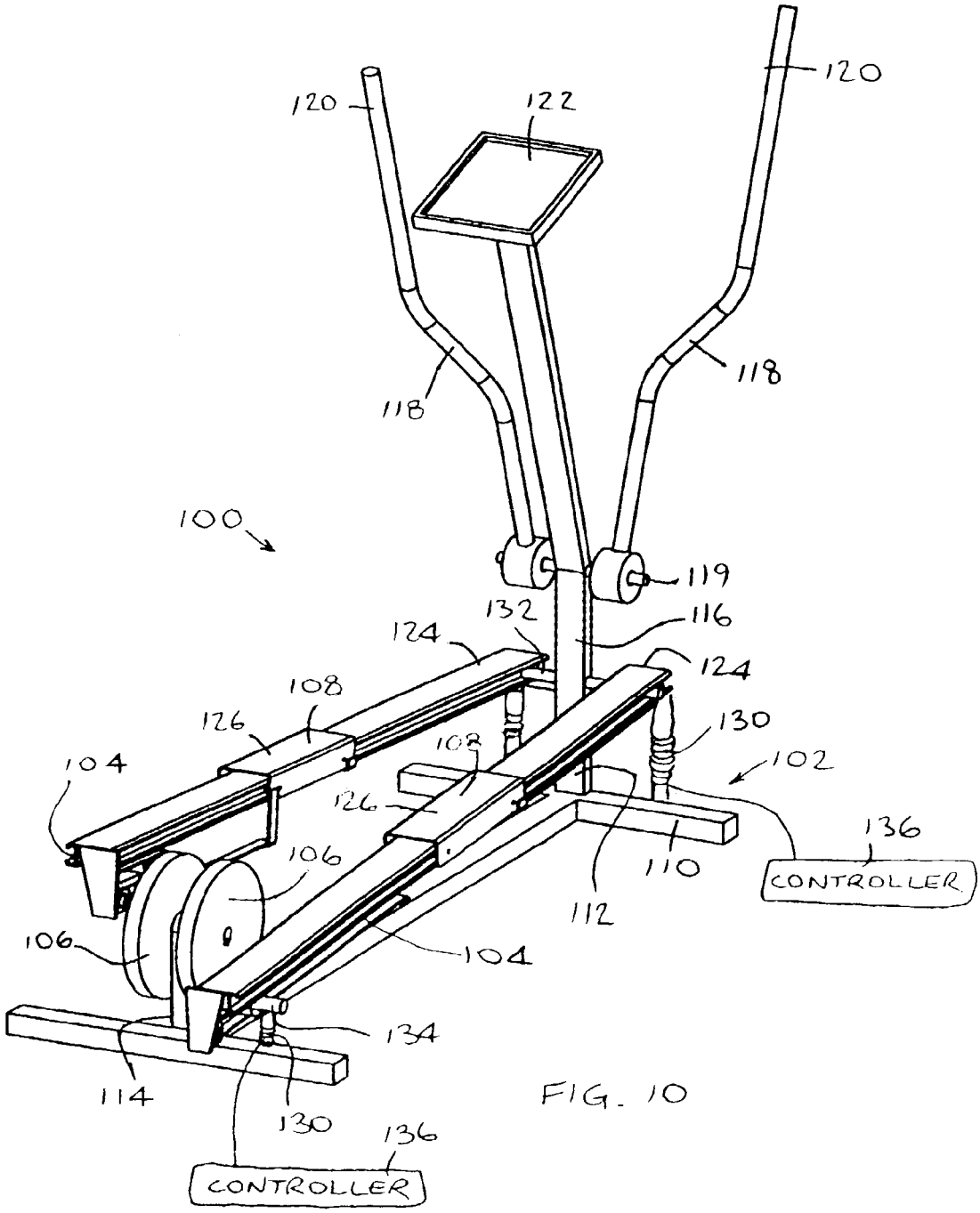
FIG. 10 is a simplified pictorial illustration of an elliptic exercise machine constructed and operative in accordance with an embodiment of the present invention.

Reference is now made to FIG. 10, which illustrates an elliptic exercise machine 100, constructed and operative in accordance with an embodiment of the present invention. Elliptic exercise machine 100 is shown for convenience with some elements similar to that of U.S. Pat. No. 5,848,954, but it is emphasized that the invention is not limited to this construction. In any case, the proprioceptive features of the invention are not found in U.S. Pat. No. 5,848,954 or any of the prior art.

Elliptic exercise machine 100 may comprise a frame 102 and a linkage assembly 104 movably mounted on frame 102. Linkage assembly 104 may generally move relative to frame 102 in a manner that links rotation of a flywheel 106 to generally elliptical motion of a force receiving member or "skate" 108. Frame 102 may include a base 110, a forward stanchion or upright 112, and a rearward stanchion or upright 114.

It is noted that the term "elliptical motion" is intended in a broad sense to describe a closed path of motion having a relatively longer first axis and a relatively shorter second axis (which extends perpendicular to the first axis). It is further noted that in the illustrated embodiment, there is left-right symmetry about a longitudinal axis, and the "right-hand" components are 180° out of phase relative to the "left-hand" components. However, like reference numerals are used to designate both the "right-hand" and "left-hand" parts on elliptic exercise machine 100, and when reference is made to one or more parts on only one side of the machine, it is to be understood that corresponding part(s) are disposed on the opposite side of the machine.

The forward stanchion 112 may extend perpendicularly upward from base 110 and support a telescoping tube or post 116. A pair of handles 118 may be pivotally mounted to post 116 at a pivot 119. Handles 118 may have gripping portions 120. A display 122 may be disposed on post 116. Skates 108 may slide on rails 124. A user may place his/her foot on a foot-contacting surface 126 of skate 108.

In accordance with an embodiment of the present invention, elliptic exercise machine 100 may comprise one or more bumping mechanisms 130 connected to a front support 132 and/or a rear support 134 of rails 124. The bumping mechanisms 130 may oscillate, rock, bump and otherwise disrupt the balance of the user of elliptic exercise machine 100. The bumping mechanisms 130 may move the user in six degrees of freedom (translation in three mutually orthogonal directions (x, y, z) and rotation about these axes (azimuth, elevation and roll)). A controller 136 may be provided to control operation of bumping mechanism 130.

Figure 11:
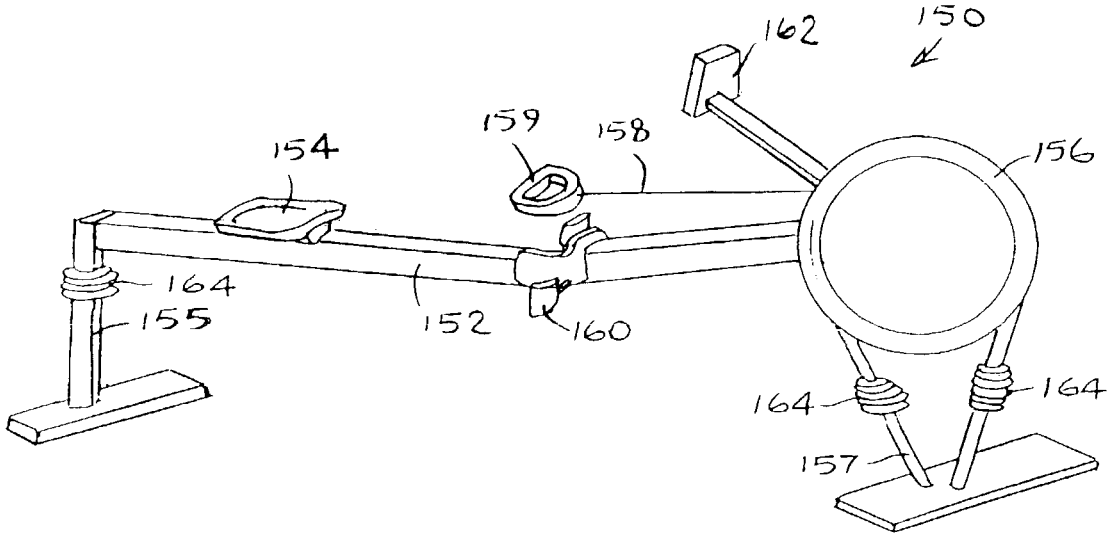
FIG. 11 is a simplified pictorial illustration of a rowing machine constructed and operative in accordance with an embodiment of the present invention.

Reference is now made to FIG. 11, which illustrates a rowing machine 150, constructed and operative in accordance with an embodiment of the present invention. Rowing machine 150 may comprise a rail 152 on which a seat 154 is slidingly mounted. Rail 152 may have a rear support 155. Rail 152 may extend from a forward-mounted tension drum 156, which may be mounted on a front support 157. A cord 158 may be wound around tension drum 156. Cord 158 may be provided with a handle 159. Footrests 160 may be mounted on rail 152.

A user (not shown) may sit on seat 154, place feet against the footrests 160, grasp handle 159 and pull cord 158 towards the rear of rowing machine 150, outwards from tension drum 156. This motion simulates the action of pulling oars in a rowboat. The seat 154 may slide back and forth on rail 152 during the rowing motion. Tension drum 156 resists the pulling action on cord 158, thereby exercising muscles used in rowing. The tension in tension drum 156 may be adjusted to suit the desired level of exercise. A controller 162 may be provided that varies the resistive force offered by tension drum 156.

In accordance with an embodiment of the present invention, rowing machine 150 may comprise one or more bumping mechanisms 164 connected to front support 157 and/or rear support 155 of rail 152, or to seat 154. The bumping mechanisms 164 may oscillate, rock, bump and otherwise disrupt the balance of the user of rowing machine 150. The bumping mechanisms 164 may move the user in six degrees of freedom (translation in three mutually orthogonal directions (x, y, z) and rotation about these axes (azimuth, elevation and roll)). Controller 162 may control operation of bumping mechanisms 164.

It will be appreciated by persons skilled in the art that the present invention is not limited by what has been particularly shown and described hereinabove. Rather the scope of the present invention includes both combinations and sub-combinations of the features described hereinabove as well as modifications and variations thereof which would occur to a person of skill in the art upon reading the foregoing description and which are not in the prior art.

What is claimed is:

1. A method for performing exercises and training for developing and improving neuromuscular control including proprioceptive and kinesthetic ability, comprising:

providing footwear comprising a support member, said support member having an upper surface and a lower surface, attaching said upper surface of said support member to a users foot, said support member comprising two bulbous protuberances that protrude from a lower surface of said support member, each protuberance having a curved outer contour, one of said protuberances being positioned more posteriorly than the other of said protuberances, and wherein at least one of said protuberances is movingly mounted on said support member, placing a users foot within the footwear, and maneuvering a users foot and performing exercises and training for developing and improving neuromuscular control while the user's foot is supported by at least one of said protuberances.

2. The method according to claim 1, comprising moving at least one of said protuberances to a different mounting position on said support member.

3. A method for performing exercises and training for developing and improving neuromuscular control including proprioceptive and kinesthetic ability, said method comprising the steps of:

providing footwear comprising a support member, said support member having an upper surface and a lower surface;

attaching said upper surface of said support member to a user's foot, said support member comprising two bulbous protuberances protruding from said lower surface of said support member where each protuberance having a curved outer contour, and one of said protuberances being positioned more posteriorly than the other of said protuberances, and wherein said protuberances are attached to a centerline of said support member, said centerline extending from a calcaneus support portion of said support member to at least one of a metatarsals support portion and phalanges support portion of said support member and wherein said protuberances are attached to said support member on opposite sides of a latitudinal midline of said support member, said latitudinal midline being halfway between a calcaneus support portion and a phalanges support portion of said support member; and maneuvering a user's foot and performing exercises and training for developing and improving neuromuscular control while the user's foot is supported by at least one of said protuberances.

* * * * *